US008303071B2

(12) United States Patent
Eun

(10) Patent No.: US 8,303,071 B2
(45) Date of Patent: Nov. 6, 2012

(54) SYSTEM AND METHOD FOR CONTROLLING REGISTRATION IN A CONTINUOUS FEED TANDEM PRINTER

(75) Inventor: Yongsoon Eun, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 320 days.

(21) Appl. No.: 12/777,929

(22) Filed: May 11, 2010

(65) Prior Publication Data

US 2011/0280638 A1 Nov. 17, 2011

(51) Int. Cl.
*B41J 29/38* (2006.01)

(52) U.S. Cl. ..... 347/16; 347/104

(58) Field of Classification Search ..... 347/16, 347/104

See application file for complete search history.

(56) References Cited

U.S. PATENT DOCUMENTS

| | | | | |
|---|---|---|---|---|
| 4,875,769 | A * | 10/1989 | Linebarger | 356/28 |
| 7,444,101 | B2 * | 10/2008 | Calamita | 399/167 |
| 7,665,817 | B2 | 2/2010 | Folkins | |
| 2008/0124158 | A1 | 5/2008 | Folkins | |
| 2009/0324262 | A1 * | 12/2009 | Matsuda et al. | 399/36 |
| 2010/0046014 | A1 | 2/2010 | Eun et al. | |
| 2011/0061552 | A1 * | 3/2011 | Eun et al. | 101/481 |

* cited by examiner

*Primary Examiner* — Julian Huffman
(74) *Attorney, Agent, or Firm* — Maginot, Moore & Beck, LLP

(57) ABSTRACT

A method enables a printing system to register images printed by two printers accurately. The method includes operating at least one marking station in a first printer with reference to a low frequency component and a high frequency of a velocity measurement for a web in the first printer, printing fiducial marks on the web with a marking station in the first printer, detecting the fiducial marks with a fiducial mark sensor in a second printer, generating a velocity measurement for the web as the web moves along a web path in the second printer that corresponds with the detected fiducial marks, and operating at least one marking station in the second printer with reference to a low frequency component and a high frequency component of the velocity measurement of the web moving along a web path in the second printer.

17 Claims, 4 Drawing Sheets

SYSTEM AND METHOD FOR CONTROLLING REGISTRATION IN A CONTINUOUS FEED TANDEM PRINTER

TECHNICAL FIELD

The system and method described below relate generally to moving web printing systems, and more particularly, to moving web printing systems that use a reflex system to register images produced from different marking stations in the system.

BACKGROUND

A known system for ejecting ink to form images on a moving web of media material is shown in FIG. 4. The system 10 includes a web unwinding unit 14, a printing apparatus 18, and a cutting station 22. In brief, the web unwinding unit 14 includes an actuator, such as an electrical motor, that rotates a roll of media material in a direction that removes a web 26 of media material from the unwinding unit 14. The web 26 is fed through the printing apparatus 18 along a path, which extends to the cutting station 22. The printer, referred to as a printing apparatus 18, treats the web 26 to remove debris and loose particulate matter from the web surface, ejects ink with numerous marking stations onto the moving web to form printed images, and then fixes the printed image to the web. The marking stations may eject different colored inks onto the web 26 to form a composite colored image. In one system 10, the marking stations eject cyan, magenta, yellow, and black ink for forming composite colored images. The web 26 is then pulled into the cutting station 22, which cuts the web into sheets for further processing.

The printing apparatus 18 uses a registration control method to control the timing of the ink ejections onto the web 26 as the web passes the marking stations. One known registration control method that may be used to operate the marking stations in the printing apparatus 18 is the single reflex method. In the single reflex method, the rotation of a single roller at or near a marking station is monitored by an encoder. The encoder may be a mechanical or electronic device that measures the angular velocity of the roller and generates a signal corresponding to the angular velocity of the roller. The angular velocity signal is processed by a controller executing programmed instructions for implementing the single reflex method to calculate the linear velocity of the web. The controller may adjust the linear web velocity calculation by using tension measurement signals generated by one or more load-cells that measure the tension on the web 26 near the roller. The controller implementing the single reflex method is configured with input/output circuitry, memory, programmed instructions, and other electronic components to calculate the linear web velocity and to generate the firing signals for the printheads in the marking stations.

Another known registration control method that may be used to operate the marking stations in the printing apparatus 18 is the double reflex method. In the double reflex method, two rollers are each monitored by an encoder. One roller lies on the web path before the marking stations and the other roller lies on the web path following the marking stations. The angular velocity signals generated by the encoders for the two rollers are processed by a controller executing programmed instructions for implementing the double reflex method to calculate the linear velocity of the web 26 at each roller and then to interpolate the linear velocity of the web at each of the marking stations. These additional calculations enable better timing of the firing signals for the printheads in the marking stations and, consequently, improved registration of the images printed by the marking stations in the printing apparatus 18.

To address demand for printing systems 10 that use a large number of colored inks, some systems 10 include printing apparatus 18, such as the one shown in FIG. 4, arranged in tandem. The tandem arrangement enables the marking stations in the two printing apparatus 18 to use different colored inks. Additionally, a web inverter may be positioned between the two printing apparatus 18 to enable the web to be turned over so the reverse surface of the web may be printed by the second printing system. This printing system 10 configuration enables the entire width of the reverse side of the web to be printed.

One issue encountered in printing systems 10 having tandem connected printing apparatus 18 is the need to synchronize the registration between the first printing apparatus and the second printing apparatus. If the two printing apparatus 18 form images on the same side of the web, then slight differences in the printed images may adversely impact image quality. Even when the two printing apparatus 18 form images on different sides of the web, registration synchronization is still important because the duplex printed web is cut into individual, double sided printed pages. If the registration is not aligned well, an image on one side of the web may creep over the length of a print job into the cutting zone between images. Addressing the registration of the images printed by the two printing apparatus on a single web would be useful.

SUMMARY

A method of coordinating registration signals between two printers enables tandem printing systems to register images printed by both printers on a single web accurately. The method includes operating at least one of marking station in a first printer with reference to a low frequency component and a high frequency of a velocity measurement for a web moving along a web path in the first printer, the velocity measurement for the web in the first printer corresponding to an angular velocity signal obtained from at least one roller in the web path of the first printer, printing fiducial marks on the web with at least one marking station in the first printer, detecting the fiducial marks on the web with a fiducial mark sensor in a second printer after the web exits the first printer, generating a velocity measurement for the web as the web moves along a web path in the second printer that corresponds with the detected fiducial marks, and operating at least one marking station in the second printer with reference to a low frequency component and a high frequency component of the velocity measurement of the web moving along a web path in the second printer, the high frequency component of the velocity measurement for the web in the second printer corresponding to an angular velocity signal obtained from at least one roller in the web path of the second printer.

A tandem printing system implements the registration control method to register images printed by two printers onto a single web accurately. The system includes a first printer that prints fiducial marks on a web as the web moves through the first printer in a process direction, a second printer that receives the web from the first printer, the second printer including a web velocity generator that is configured to detect the fiducial marks printed on the web by the first printer and to generate a web velocity measurement for the web as the web moves through the second printer in the process direction, a low pass filter operatively connected to the web velocity generator to generate a low frequency web velocity signal, a first roller that is rotated by the web as the web moves through the second printer and is configured with an encoder to generate an angular velocity signal corresponding to the angular velocity of the first roller as the first roller rotates, a first converter operatively connected to the encoder for the first roller and configured to generate a web velocity measurement corresponding to the angular velocity of the first roller, a first high pass filter operatively connected to the first converter to generate a first high frequency web velocity signal, and a controller operatively connected to the low pass filter, the first high pass filter, and a plurality of marking stations in the second printer, the controller being configured to generate firing signals for the marking stations with reference to the low frequency web velocity signal and the first high frequency web velocity signal.

BRIEF DESCRIPTION OF THE DRAWINGS

The foregoing aspects and other features of a system and method that enables accurate registration of images printed by two printers onto the same web are explained in the following description, taken in connection with the accompanying drawings.

DETAILED DESCRIPTION

Figure 1:
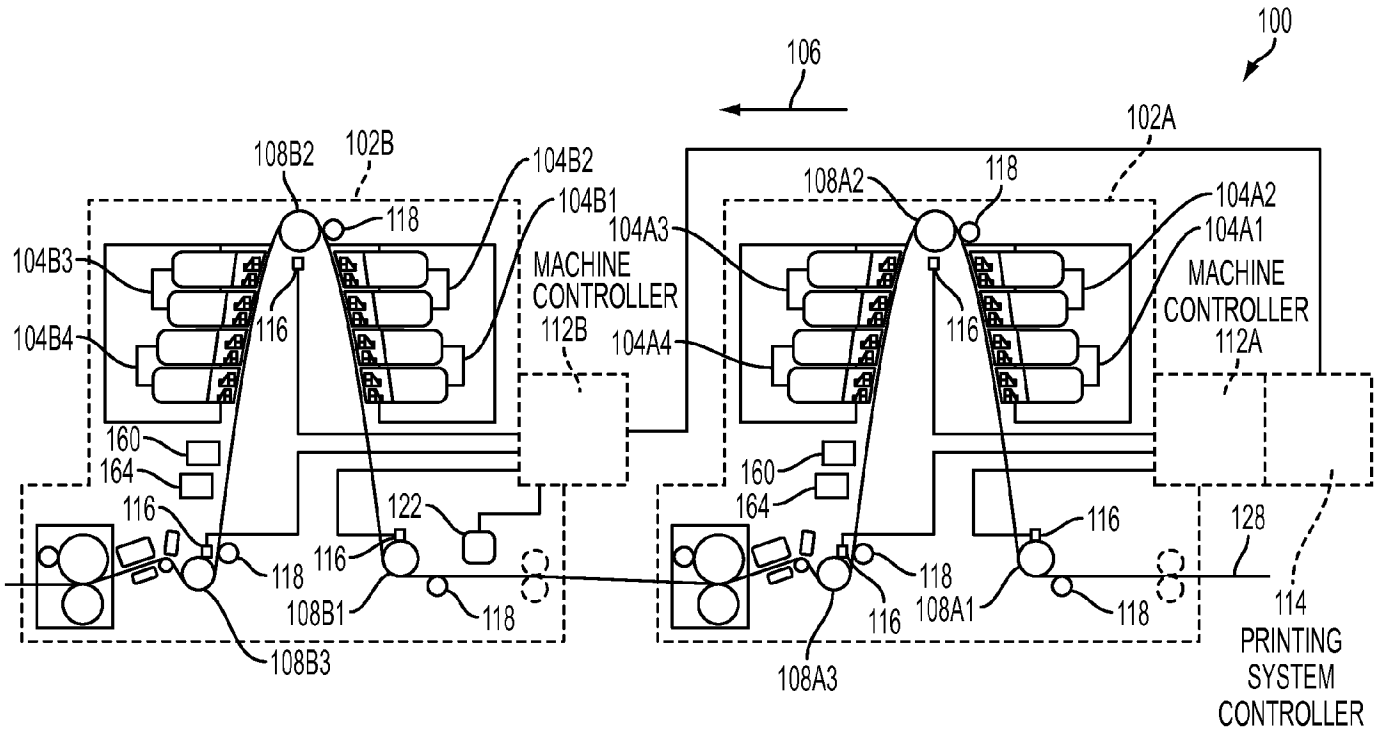
FIG. 1 is a block diagram of a tandem printer system having two printers each being configured to print images on a continuous web of print media with the second printer determining web velocity with reference to fiducial markings printed by the first printer.

Reference is made to the drawings for a general understanding of the environment and details for the system and method disclosed herein. In the drawings, like reference numerals have been used throughout to designate like elements. As used herein, the terms "printer" and "printing apparatus", which may be used interchangeably, each encompasses any apparatus that performs a print outputting function for any purpose, such as a digital copier, bookmaking machine, facsimile machine, a multi-function machine, or the like. Furthermore, a printer is an apparatus that forms images with marking material on media and fixes and/or cures the images before the media exits the printer for collection or further printing by a subsequent printer. The term "fixing" may refer to the stabilization of ink on media through components operating on the ink and/or the media, including, but not limited to, fixing rollers and the like. Additionally or alternatively, the term "fixing" may refer to the stabilization of ink on media through environmental effects such as, but not limited to, evaporation and drying as in the case of aqueous ink, and the like. The process of "curing" ink refers to curable compounds in an ink undergoing an increase in molecular weight upon exposure to radiation, such as by crosslinking, chain lengthening, or the like. Cured ink is suitable for document distribution, is resistant to smudging, and may be handled by a user. Furthermore, as used herein, the term "tandem printing system" refers to a system in which two or more printers are configured serially to enable media to pass through the printers along a contiguous path so the media printed by one printer may be subsequently printed upon by another printer in the tandem system that follows in a process direction.

As shown in FIG. 1, a continuous feed tandem printing system 100 is shown with two serially connected printing apparatus 102A, 102B, which print images on a continuous web 128 of print media. The continuous web 128 moves through the printing system 100 from the printing apparatus 102A to the printing apparatus 102B in a process direction 106. Both printing apparatus 102A, 102B use a reflex registration system for the generation of printhead firing signals to register ink ejected by printhead arrays that follow other printhead arrays in the process direction. The reflex registration system in each apparatus 102A, 102B determines the composite linear velocity of the web 128 as the web moves through an apparatus in order to synchronize the timing of the firing signals and the ejection of the ink onto the web. The printing apparatus 102A determines the composite linear velocity with reference to the angular velocity of rollers and tension measurements for the web 128 within the apparatus 102A. The printing apparatus 102B determines a composite linear velocity of the web 128 based at least in part on an angular velocity of a roller within the apparatus 102B and a fiducial mark printed on the web by the printing apparatus 102A. The use of the fiducial marks printed by the apparatus 102A in the determination of the composite linear velocity by the reflex registration system in the apparatus 102B enables the ink ejections of the printheads in the apparatus 102B to be synchronized with the images printed on the web by the apparatus 102A. The tandem printing system 100 as depicted in FIG. 1 includes only two printing apparatus 102A, 102B to facilitate the discussion; however, any number of printing apparatus may be connected in tandem.

The apparatus 102A and 102B may implement either a single reflex or a double reflex registration system to time the delivery of firing signals to printheads in a print zone of a web printing system. "Double reflex registration system" refers to a system that uses the angular velocity signals corresponding to the rotation of two or more rollers to compute the web velocity at a printhead positioned between the rollers. A single reflex registration system refers to a system that uses the angular velocity signals corresponding to the rotation of only one roller to compute a linear web velocity that is used to predict web positions and timing in a print zone. A double reflex control system is described in U.S. Pat. No. 7,665,817, which is entitled "Double Reflex Printing" and which issued on Feb. 23, 2010 and is owned by the assignee of the present application. The disclosure of this patent is expressly incorporated herein by reference in its entirety.

The printing apparatus 102A of FIG. 1 includes marking stations 104A1, 104A2, 104A3, 104A4; rollers 108A1, 108A2, 108A3; a machine controller 112A; a printing system controller 114; encoders 116; loadcells 118; an ink leveling device 160; and an ink curing device 164. The marking stations 104A1, 104A2, 104A3, 104A4 are mechanically connected to a printer frame and electronically connected to the machine controller 112. The marking stations 104A1, 104A2, 104A3, 104A4 are configured to eject droplets of liquid ink onto the continuous web 128 of print media in response to receiving firing signals from the controller 112A. The rollers 108A1, 108A2, 108A3, which are connected to the printer frame for rotation about a longitudinal axis, are rotated by the continuous web 128 as the web moves through the printing apparatus 102A along a web path. A print zone extends from the roller 108A1 to the roller 108A2 and from the roller 108A2 to the roller 108A3. The encoders 116 generate an angular velocity signal corresponding to an angular velocity of a respective one of the rollers 108A1, 108A2, and 108A3. Each encoder 116 may be a mechanical or electronic device as known to those of ordinary skill in the art. An electrical output of each encoder 116 is processed by a converter 120 (FIG. 2), which converts a respective one of the angular velocity signals to a linear velocity signal. The loadcells 118 generate electronic signals indicative of a tension of the web near the loadcells. The printing system controller 114 is configured to receive and/or generate image printing scheduling data, among other functions, and is electrically connected to the controller 112A and each other controller 112A, 112B in the printing system 100. The controller 114 may be configured to coordinate the operation of two or more printing apparatus 102A, 102B. The machine controller 112A generates firing signals with reference to the linear velocity at each point of the continuous web 128 proximate to a marking station. The controller 112A is associated with only the printing apparatus 102A. The ink leveling device 160 and the ink curing device 164 are connected to the printer frame subsequent to the marking stations to prepare certain inks for document distribution.

As also shown in FIG. 1, the printing apparatus 102B includes marking stations 104B1, 104B2, 104B3, 104B4; rollers 108B1, 108B2, 108B3; a machine controller 112B; encoders 116; loadcells 118; an ink leveling device 160; and an ink curing device 164, which are each connected and configured to function similarly to the like components described with reference to the printing apparatus 102A. The printing apparatus 102B, however, generally does not include a printing system controller 114; instead, the machine controller 112B, which is associated with only the printing apparatus 102B, is connected to the system controller 114. Additionally, the printing apparatus 102B includes a sensor 122 configured to detect fiducial marks printed on the continuous web 128 by the printing apparatus 102A.

A registration synchronization technique that uses Registration of Form ("ROF") marks (referred to as fiduciary markers, fiducial marks, or just fiducials) alone is insufficient for coordinating the operations of the two printers. Fiducial marks, as used in this document, are ink drops ejected in a predetermined pattern by inkjet ejectors in at least one printhead onto media passing by the printhead. Detection of the fiducial marks may be used with data regarding the predetermined pattern to identify a linear velocity for the media. A linear web velocity calculated with reference to fiducial marks alone is slightly different than a linear web velocity calculated by a reflex registration system. Various factors may contribute to the difference between the two velocities. These factors, include, but are not limited to, uncertainty in roller diameter, thermal expansion of the rollers, and uncertainty in the calibration of the loadcells. If the second printer attempts to use the velocity of the web computed with reference to the fiducials alone, then marking station to marking station misregistration within the second printer occurs because the advantages of the reflex registration system are no longer available. If the second printer relies on a reflex registration system alone, the differences between components in the second printer and components in the first printer produce different velocities for the two printers and the images printed by the two apparatus will begin to move with respect to one another over time.

To address this issue, the printing apparatus 102B (a second printer) of the present disclosure calculates a composite linear velocity with reference to (i) the linear velocity calculated with reference to the fiducials and (ii) the linear velocity associated with the double reflex registration system. The composite velocity maintains the benefits of the marking station-to-marking station registration achieved with double reflex registration without sacrificing the process direction registration synchronization associated with the velocity calculated with reference to the fiducials.

The marking stations 104A1, 104A2, 104A3, 104A4, 104B1, 104B2, 104B3, 104B4, sometimes referred to as printhead arrays or inkjet arrays, each include an ink reservoir, inkjet ejectors, and nozzles as known to those of ordinary skill in the art, but not illustrated in FIG. 1. The nozzles are fluidly connected to an ink reservoir to receive liquid ink from the ink reservoir. The inkjet ejectors receive firing signals from one of the controllers 112A, 112B in a known manner and, in response, eject ink droplets onto the continuous web 128. The inkjet ejectors may be thermal inkjet ejectors, piezoelectric inkjet ejectors, or any other inkjet ejector known to those of ordinary skill in the art. Although the marking stations shown are in the form of sets of inkjet arrays, each marking station corresponds to one primary color or other type of marking material; however, other types of marking stations and arrangements are possible, such as each marking station being capable of printing multiples colors or types and/or one or more marking stations utilizing electrophotography or ionography. Additionally, each of the marking stations 104A1, 104A2, 104A3, 104A4, 104B1, 104B2, 104B3, 104B4 is associated with only one of the printing apparatus 102A, 102B.

The rollers 108A1, 108A2, 108A3, 108B1, 108B2, 108B3 may be any type of roller configured to guide the continuous web 128, as known to those of ordinary skill in the art. As shown in FIG. 1, the roller 108B1 is positioned before the marking stations 104B1, 104B2, 104B3, 104B4 in the direction of web motion and the roller 108B2 is positioned after the marking stations 104B1, 104B2 and before the marking stations 104B3, 104B4 in the direction of web motion. Similarly, the roller 108B3 is positioned after the marking stations 104B1, 104B2, 104B3, 104B4 in the direction of web motion.

The sensor 122, which may also be referred to as a detector, is connected to the printer frame of the printing apparatus 102B and is configured to generate an electronic signal in response to detecting fiducial marks on the continuous web 128. The electronic signal generated by the sensor 122 is converted to a linear velocity of the continuous web 128 as measured in the proximity of the sensor. The sensor 122 may include hardware and/or software configured to generate directly a linear velocity of the continuous web 128. Such a sensor 122 may be referred to as a web velocity generator, and may be connected directly to the filter 136 (FIG. 2) of the controller 112B. Alternatively, the sensor 122 may be connected to a converter 126 (FIG. 2), which converts the signal generated by the sensor into the linear velocity. The sensor 122 is positioned prior to the marking stations 104B1, 104B2, 104B3, 104B4, as measured in the process direction 106, to detect the velocity of a portion of the continuous web 128 before the portion receives ink from one or more of the marking stations 104B1, 104B2, 104B3, 104B4.

The sensor 122 may be implemented with any device configured to detect fiducial marks, including an optical sensor, which generates image data associated with light reflected off the continuous web. For example, the sensor 122 may be implemented with an optical sensor/detector that generates an electrical signal if it optically detects the fiducials. Alternatively, the sensor 122 may be implemented with an image-on-web array ("IOWA") sensor, which includes a plurality of optical sensors that are arranged in a single or multiple row array that extends across the entirety or a portion of the width of the continuous web 128, as measured in a cross process direction. Each optical sensor generates a signal having an intensity that corresponds to light reflected off the continuous web 128. The light is generated by a light source that may be incorporated in the IOWA sensor and is directed toward the surface of the continuous web 128 to illuminate the surface as it passes the optical sensor. The intensity of the reflected light is dependent upon the amount of light absorbed by the ink on the continuous web 128, the light scattered by the structure of the continuous web, and the light reflected by the ink and continuous web, among other factors. The image data generated by the IOWA are processed by a controller configured to analyze structure in the image data to identify the position of the ink drops in the fiducials. This positional information may be converted into the linear velocity of the continuous web 128 as measured at or near the point of detection.

The sensor 122 may also be implemented with a device configured to detect magnetic or other reactive properties of the ink used to print the fiducial marks. For example, one or more of the marking stations 104A1, 104A2, 104A3, 104A4 may print fiducial marks with an ink composition having magnetic properties, such as the inks used in a magnetic ink character recognition system ("MICR"). In particular, the fiducial marks may be printed a known distance from each other as measured in the process direction 106, such that the sensor 122 may generated a linear velocity, among other ways, by dividing the distance between the fiducial marks by the elapsed time between the detection of the fiducial marks.

Figure 2:
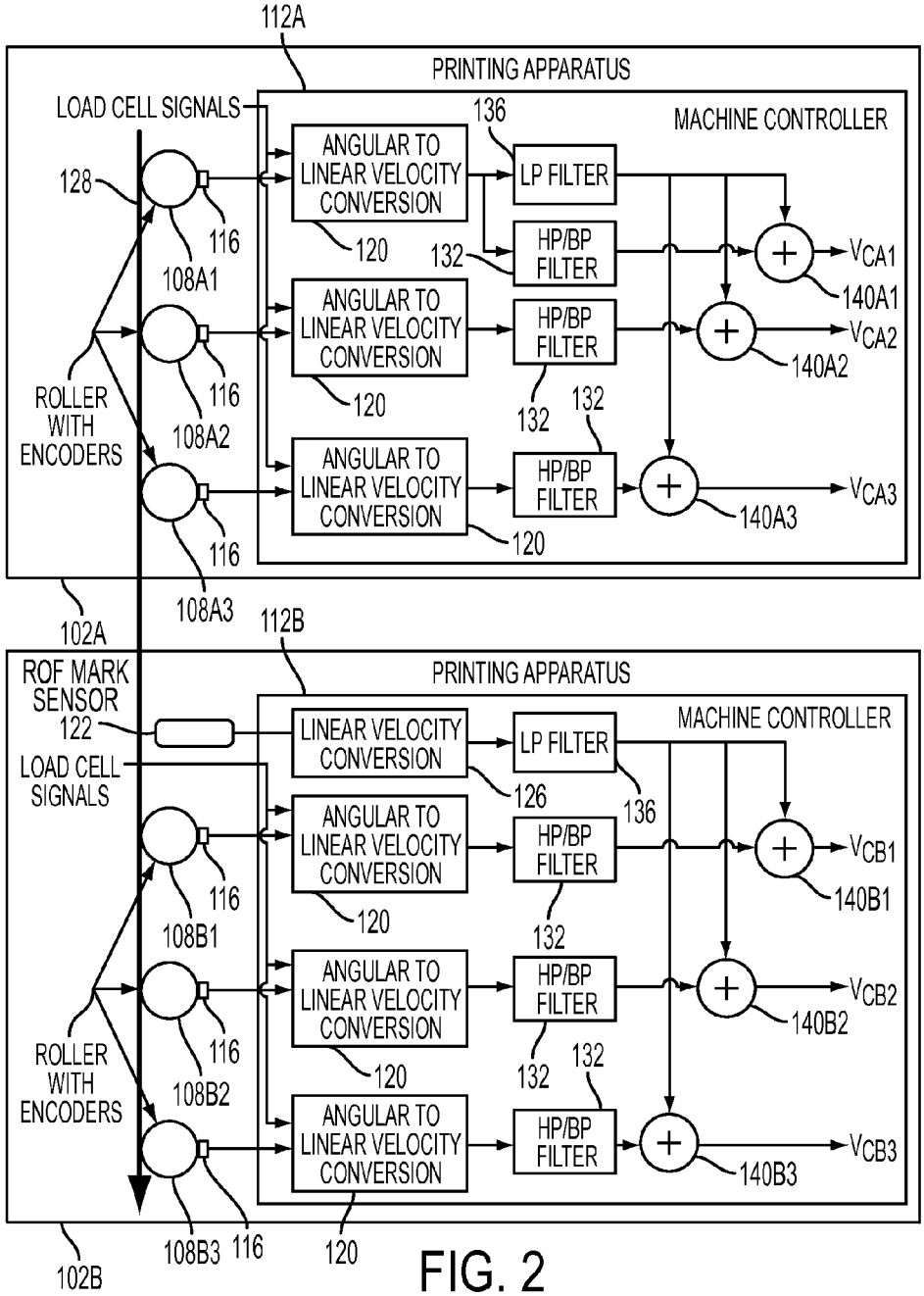
FIG. 2 is a block diagram illustrating hardware/software components within machine controllers of the printers of FIG. 1.

As shown in FIG. 2, the machine controller 112A of the printing apparatus 102A includes filters 132, 136 and adders 140A1, 140A2, 140A3, which are coupled to converters 120. Likewise, the machine controller 112B of the printing apparatus 102B includes filters 132, 136 and adders 140B1, 140B2, 140B3, which are coupled to converters 120, 126. The converters 120 may be stand-alone processors, application specific integrated circuits ("ASICs"), or hardware/software circuits that convert an angular velocity signal to a linear web velocity. In general, the converters 120 generate the linear velocity signal with reference to the circumference of a respective one of the rollers 108A1, 108A2, 108A3, 108B1, 108B2, 108B3 and a number of pulses produced by the encoders 116 per revolution of the rollers. Additionally, each of the converters 120 may receive loadcell signals from one of the loadcells 118 (FIG. 1). Each loadcell may be configured to generate an electronic signal that corresponds to tension on the web 128 at various positions. These tension measurements and other data, such as the mass of the web 128 per unit of length of the web 128, may be used to adjust the linear velocities generated by the converters 120. These adjustments to the linear velocity may be made prior to the filtering of the linear velocities described below. The converter 126 may be a stand-alone processor, ASIC, or hardware/software circuit that generates a linear velocity with reference to the electronic signal generated by the sensor 122. In general, the converter 126 generates the linear velocity with reference to an elapsed time between detected fiducials and a distance between the fiducials. The combination of the converter 126 and the sensor 122 may be referred to as a web velocity generator.

With reference to both controllers 112A, 112B, each of the converters 120 is coupled to a respective one of the high pass filters 132. The output of each high pass filter 132 is received by a respective one of the adders 140A1, 140B1, 140C1, 140A2, 140B2, 140C2. The high pass filters 132 enable only the relatively rapid changes in linear velocity to pass through. In one embodiment, the high pass filters 132 have a cutoff frequency of approximately 0.1 Hz. The cutoff frequency for any filter discussed in this document may be adjusted to accommodate the system parameters, such as web length, average speed, media density, and the like. The high pass filters 132, in effect, remove the average velocity component of the output signals of the encoders 116.

The low pass filter 136 of the controller 112A is coupled to the output of the converter 120 associated with the roller 108A1 to receive the linear velocity measured by the converter. The low pass filter 136 of the controller 112B, which is associated with the sensor 122, is coupled to the output of the converter 126 to receive the linear velocity generated by the converter 126. The cutoff frequency for each of the low pass filters 136 is approximately 0.1 Hz, such that the output of each filter 136 is a relatively slow changing signal, which corresponds to the average linear velocity of the web 128 at one of the roller 108A1 and the sensor 122. Furthermore, the reader should note that the average linear velocity of the web 128 throughout the print zone of the printing apparatus 102A does not change at the rollers 108A1, 108A2, 108A3; otherwise, the web 128 would break or go slack. Similarly, the average linear velocity of the web 128 throughout the print zone of the printing apparatus 102B does not change at the rollers 108B1, 108B2, 108B3; otherwise, the web 128 would break or go slack.

With continued reference to FIG. 2, each adder 140A1, 140A2, 140A3, 140B1, 140B2, 140B3 sums a respective one of the low pass filtered signals with the high pass filtered signal for a corresponding one of the rollers 108A1, 108A2, 108A3, 108B1, 108B2, 108B3. Specifically, the adder 140A1 adds the low pass filtered signal from the filter 136 associated with the roller 108A1 and the high pass filtered signal from the filter 132 associated with the roller 108A1. The composite output velocity $V_{CA1}$ of the adder 140A1 represents the average linear velocity of the web 128 at the roller 108A1 combined with the high frequency variations in the linear web velocity at the roller 108A1. The adder 140A2 adds the low pass filtered signal for the filter 136 associated with the roller 108A1 and the high pass filtered signal from the filter 132 associated with the roller 108A2. The composite output velocity $V_{CA2}$ of the adder 140A2 represents the average linear velocity of the web 128 at roller 108A1 combined with the high frequency variations in the linear web velocity at the roller 108A2. The adder 140A3 adds the low pass filtered signal from the filter 136 associated with the roller 108A1 and the high pass filtered signal from the filter 132 associated with the roller 108A3. The composite output velocity $V_{CA3}$ of the adder 140A3 represents the average linear velocity of the web 128 at the roller 108A1 combined with the high frequency variations in the linear web velocity at the roller 108A3. Referring now to the controller 112B, the adder 140B1 adds the low pass filtered signal from the filter 136 associated with the sensor 122 and the high pass filtered signal from the filter 132 associated with the roller 108B1. The composite output velocity $V_{CB1}$ of the adder 140B1 represents the average linear velocity of the web 128 as measured near the sensor 122 combined with the high frequency variations in the linear web velocity at the roller 108B1. The adder 140B2 adds the low pass filtered signal for the filter 136 associated with the sensor 122 and the high pass filtered signal from the filter 132 associated with the roller 108B2. The composite output $V_{CB2}$ of the adder 140B2 represents the average linear velocity of the web 128 as measured near the sensor 122 combined with the high frequency variations in the linear web velocity at the roller 108B2. The adder 140B3 adds the low pass filtered signal from the filter 136 associated with the sensor 122 and the high pass filtered signal from the filter 132 associated with the roller 108B3. The composite output $V_{CB3}$ of the adder 140B3 represents the average linear velocity of the web 128 as measured near the sensor 122 combined with the high frequency variations in the linear web velocity at the roller 108B3.

By using the composite velocity signals $V_{CA1}$, $V_{CA2}$, $V_{CA3}$, the controller 112A avoids web velocity calculation errors associated with linear velocity variations occurring at each roller 108A1, 108A2, 108A3, because each composite velocity signal is equalized to the low frequency component of the linear web velocity as measured by the encoder 116. Similarly, by using the composite velocity signals $V_{CB1}$, $V_{CB2}$, $V_{CB3}$, the controller 112B avoids web velocity calculation errors associated with linear velocity variations occurring at each roller 108B1, 108B2, 108B3, because each composite velocity signal is equalized to the low frequency component of the linear web velocity as measured by the sensor 122. This common baseline for the linear web velocity at each roller 108A1, 108A2, 108A3, 108B1, 108B2, 108B3 improves the accuracy of the web velocity calculation at each roller. Consequently, the interpolated web velocities computed by the controller 112A, 112B for each marking station 104A1, 104A2, 104A3, 104A4, 104B1, 104B2, 104B3, 104B4 are calculated with greater accuracy and mis-registration occurs less frequently.

As described above, the controllers 112A, 112B use the composite signal outputs $V_{CA1}$, $V_{CA2}$, $V_{CA3}$, $V_{CB1}$, $V_{CB2}$, $V_{CB3}$ to compute and/or interpolate the web velocity at the rollers 108A1, 108A2, 108A3, 108B1, 108B2, 108B3 and the marking stations 104A1, 104A2, 104A3, 104A4, 104B1, 104B2, 104B3, 104B4. The controllers 112A, 112B include electronic memory to store data and programmed instructions, which may be executed with general or specialized programmable processors. The programmed instructions, memories, and interface circuitry configure the controllers 112A, 112B to perform the functions for computing the velocity of the web 128 at various locations and to generate firing signals in relation with those computed velocities. The components of each controller 112A, 112B may be provided on a printed circuit card or provided as a circuit in an ASIC. Each of the circuits may be implemented with a separate processor or multiple circuits may be implemented on the same processor. Alternatively, the circuits may be implemented with discrete components or circuits provided in VLSI circuits. Also, the circuits described herein may be implemented with a combination of processors, ASICs, discrete components, or VLSI circuits.

The controllers 112A, 112B may implement a single reflex registration method. The controller 112A, when operating in the single reflex registration mode, computes firing signals for the printheads in the markings stations 104A1, 104A2, 104A3, 104A4 with reference to the composite velocity $V_{CA1}$, which includes a low frequency component and a high frequency component of the linear web velocity associated with the angular velocity of only the roller 108A1. The controller 112B, when operating in the single reflex registration mode, computes firing signals for the printheads in the marking stations 104B1, 104B2, 104B3, 104B4 with reference to the composite velocity $V_{CB1}$, which includes a low frequency component of the velocity as measured by the sensor 122 and a high frequency component of the linear web velocity associated with the angular velocity of only the roller 108B1. Each controller 112A, 112B may modify the velocity calculation made during the single reflex registration method with web tension measurements obtained from the loadcells 118.

To account for the differences in instantaneous velocities at the rollers 108A1, 108A2, 108A3 in or near the print zone, the controllers 112A, 112B may implement a double reflex registration method to interpolate the linear web velocity at points between a given pair of the rollers, with one roller of the pair of the rollers on each side of a marking station to identify the linear velocity for the web at positions proximate the marking stations. The controller 112A, when implementing the double reflex registration mode, interpolates the linear web velocity at a particular one of the marking stations 104A1, 104A2, 104A3, 104A4 by using (i) one of the composite linear web velocities $V_{CA1}$, $V_{CA2}$, $V_{CA3}$ derived from the angular velocity of one of the rollers 108A1, 108A2, 108A3 placed at a position before the web 128 passes the marking station, (ii) another of the composite linear web velocities $V_{CA1}$, $V_{CA2}$, $V_{CA3}$ derived from the angular velocity of another one of the rollers 108A1, 108A2, 108A3 placed at a position after the web passes the marking station, and (iii) the relative distances between the marking station and the two rollers. The interpolated value corresponds to a linear web velocity at the particular marking station 104A1, 104A2, 104A3, 104A4. A linear web velocity is interpolated for each marking station 104A1, 104A2, 104A3, 104A4 to enable the controller 112A to generate the firing signals for the printheads in each marking station to eject ink as the appropriate portion of the web 128 travels past each marking station. The controller 112B, when implementing the double reflex registration mode, interpolates the linear web velocity at a particular one of the marking stations 104B1, 104B2, 104B3, 104B4 by using (i) one of the composite linear web velocities $V_{CB1}$, $V_{CB2}$, $V_{CB3}$ derived from the angular velocity of one of the rollers 108B1, 108B2, 108B3 placed at a position before the web 128 passes the marking station, (ii) another of the composite linear web velocities $V_{CB1}$, $V_{CB2}$, $V_{CB3}$ derived from the angular velocity of another one of the rollers 108B1, 108B2, 108B3 placed at a position after the web passes the marking station, and (iii) the relative distances between the marking station and the two rollers. The interpolated value correlates to a linear web velocity at the particular marking station 104B1, 104B2, 104B3, 104B4. A linear web velocity is interpolated for each marking station 104B1, 104B2, 104B3, 104B4 to enable the controller 112B to generate the firing signals for the printheads in each marking station to eject ink as the appropriate portion of the web 128 travels past each marking station. Each controller 112A, 112B may modify the velocity calculations made during the double reflex registration method with web tension measurements obtained from the loadcells 118.

Figure 3:
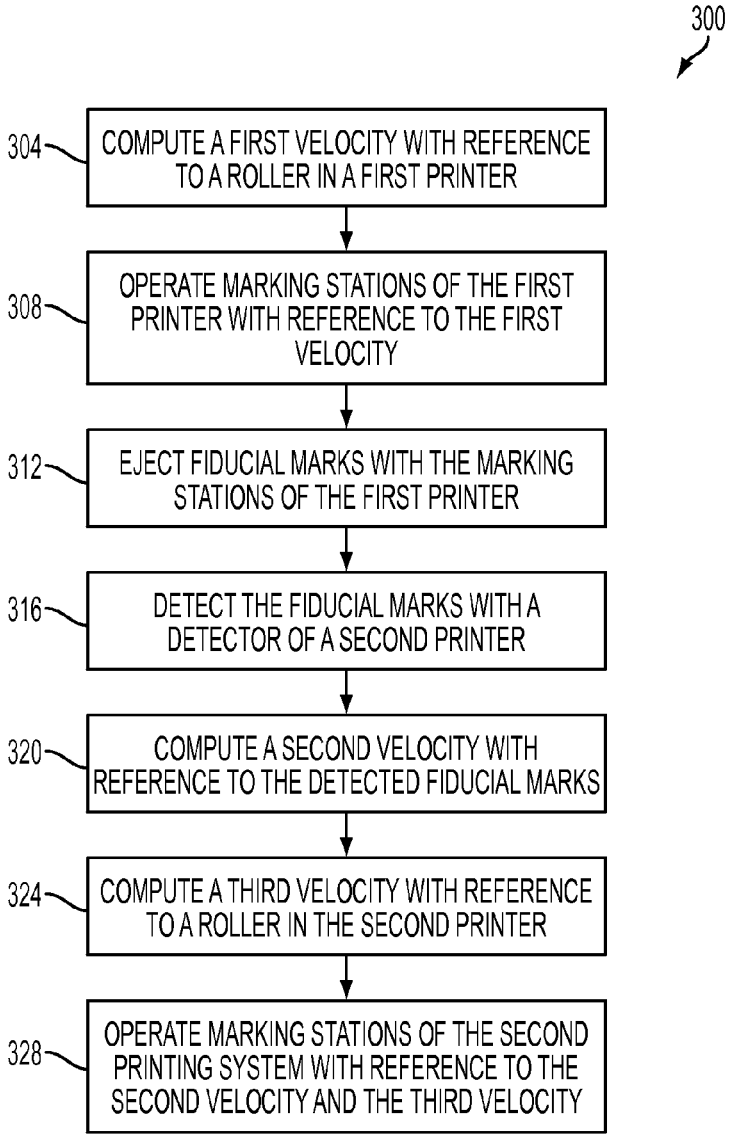
FIG. 3 is a flowchart of a process that may be implemented by the printing system of FIG. 1.
Figure 4:
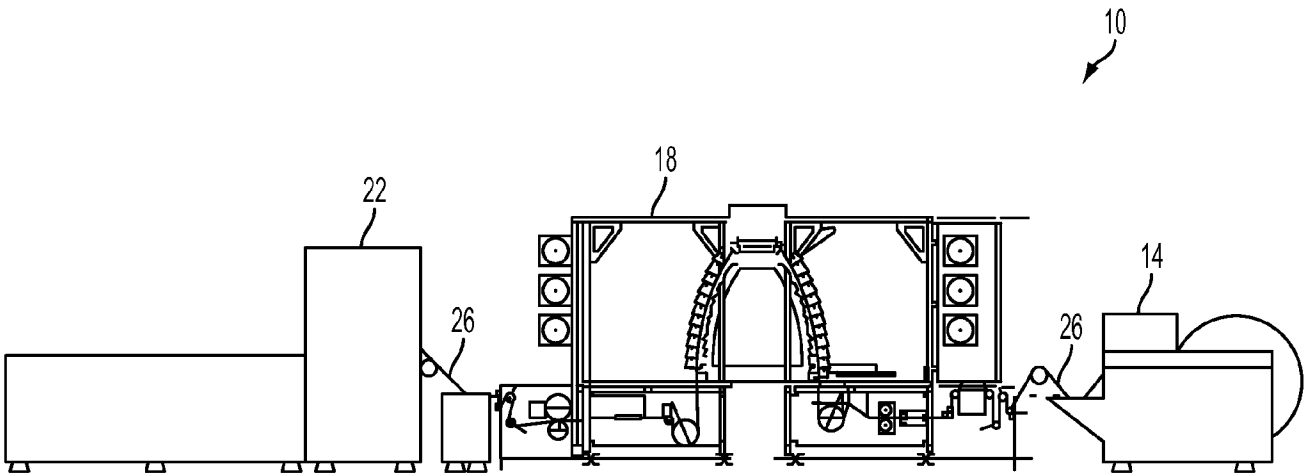
FIG. 4 PRIOR ART
FIG. 4 is a block diagram of a known printing system configured to print images on a continuous web of print media.

The printing system 100 may be operated according to the process 300 illustrated by the flowchart of FIG. 3. First, the printing apparatus 102A computes at least one of the velocities $V_{CA1}$, $V_{CA2}$, $V_{CA3}$ (block 304). Second, the printing apparatus 102A operates at least one of the marking stations 104A1, 104A2, 104A3, 104A4 with reference to the at least one computed velocity $V_{CA1}$, $V_{CA2}$, $V_{CA3}$ to eject an image and fiducial marks onto the continuous web (blocks 308 and 312). Third, the portion of the continuous web 128 having the fiducial marks and the image exits the printing apparatus 102A and enters the printing apparatus 102B. The sensor 122 detects the fiducial marks printed on the continuous web 128 by the printing apparatus 102A (block 316). Fourth, the printing apparatus 102B generates a sensor linear web velocity with reference to the signal generated by the sensor 122, as represented in FIG. 2 by the signal generated by the converter 126 (block 320). Additionally, the printing apparatus 102B generates a roller linear web velocity with reference to the angular velocity of at least one of the rollers 108B1, 108B2, 108B3 (block 324). Next, the marking stations of the printing apparatus 102B are operated with reference to the sensor linear web velocity and the roller linear web velocity, as represented in FIG. 2 by the velocities $V_{CB1}$, $V_{CB2}$, $V_{CB3}$, which enables the printing apparatus 102B to register a printed image with respect to (i) the printed image formed by the printing apparatus 102A and (ii) the image printed by each of the marking stations 104B1, 104B2, 104B3, 104B4 with each of the other markings stations of the printing apparatus 102B (block 328).

The printing system 100 prints images on the continuous web 128 with one of numerous ink compositions. Exemplary ink compositions include, but are not limited to, phase change inks, gel based inks, curable inks, aqueous inks, and solvent inks. As used herein, the term "ink composition" encompasses all colors of a particular ink composition including, but not limited to, usable color sets of an ink composition. For example, an ink composition may refer to a usable color set of phase change ink that includes cyan, magenta, yellow, and black inks. Therefore, as defined herein, cyan phase change ink and magenta phase change ink are different ink colors of the same ink composition.

The term "phase change ink", also referred to as "solid ink", encompasses inks that remain in a solid phase at an ambient temperature and that melt to a liquid phase when heated above a threshold temperature, referred to in some instances as a melt temperature. The ambient temperature is the temperature of the air surrounding the printing system 100; however, the ambient temperature may be a room temperature when the printing system is positioned in an enclosed or otherwise defined space. An exemplary range of melt temperatures for phase change ink is approximately seventy degrees (70°) to one hundred forty degrees (140°) Celsius; however, the melt temperature of some phase change inks may be above or below the exemplary melt temperature range. When phase change ink cools below the melt temperature the ink returns to the solid phase. The marking stations eject phase change ink in the liquid phase onto the continuous web 128 and the ink becomes affixed to the web in response to the ink cooling below the melt temperature.

The terms "gel ink" and "gel based ink", as used herein, encompass inks that remain in a gelatinous state at the ambient temperature and that may be heated or otherwise altered to have a different viscosity suitable for ejection onto the continuous web 128 by the marking stations 104A1, 104A2, 104A3, 104A4, 104B1, 104B2, 104B3, 104B4. Gel ink in the gelatinous state may have a viscosity between $10^5$ and $10^7$ centipoise ("cP"); however, the viscosity of gel ink may be reduced to a liquid-like viscosity by heating the ink above a threshold temperature, referred to as a gelation temperature. An exemplary range of gelation temperatures is approximately thirty degrees (30°) to fifty (50°) degrees Celsius; however, the gelation temperature of some gel inks may be above or below the exemplary gelation temperature range. The viscosity of gel ink increases when the ink cools below the gelation temperature. Some gel inks ejected onto the continuous web 128 become affixed to the web in response to the ink cooling below the gelation temperature.

Some ink compositions, referred to herein as curable inks, are cured by the printing system 100. As used herein, the process of "curing" ink refers to curable compounds in an ink undergoing an increase in molecular weight in response to being exposed to radiation. Exemplary processes for increasing the molecular weight of a curable compound include, but are not limited to, crosslinking and chain lengthening. Cured ink is suitable for document distribution, is resistant to smudging, and may be handled by a user. Radiation suitable to cure ink may encompass the full frequency (or wavelength) spectrum including, but not limited to, microwaves, infrared, visible, ultraviolet, and x-rays. In particular, ultraviolet-curable gel ink, referred to herein as UV gel ink, becomes cured after being exposed to ultraviolet radiation. As used herein, the term "ultraviolet" radiation encompasses radiation having a wavelength from approximately fifty nanometers (50 nm) to approximately five hundred nanometers (500 nm).

In response to being configured to print curable ink, each printing apparatus 102A, 102B of the printing system 100 includes a leveling device 160 and a curing assembly 164. The ink leveling device 160 is configured to spread ink droplets ejected onto the continuous web 128 into a substantially continuous area without physically contacting the ink droplets. When ink droplets contact the continuous web 128 there may be a space between each ink droplet and a plurality of surrounding ink droplets. The ink leveling 160 device flattens the ink droplets such that each ink droplet contacts one or more adjacent ink droplets to form a continuous area of ink. The ink leveling device 160 is commonly used to spread gel ink; however, the ink leveling device is not limited to spreading only gel ink. The ink leveling device 160 may expose the ink to infrared radiation to spread the ink without contacting the ink.

The curing assembly 164 may be mounted to the printer frame subsequent to the marking stations and the leveling device 160, as measured in the process direction 106, to cure the ink ejected onto the continuous web 128. The curing assembly 164 is positioned along the web path to cure the ink ejected onto the continuous web 128 before the ejected ink contacts any of a series of rollers (for example, the rollers 108A3 and 108B3), which guide the web along the web path. The curing assembly 164 may expose the ink to ultraviolet radiation to cure the ink.

The printing system 100 has been described as a simplex printing system in which an image is formed on only one side of the continuous web 128. The printing system 100, however, may also be a duplex printing system in which an image is formed on both sides of the continuous web 128, with the addition of a web inverter as known to those of ordinary skill in the art. The web inverter may be placed to receive the continuous web 128 in a first orientation from the printing apparatus 102A and to deliver the continuous web 128 in an inverted orientation to the input of the printing apparatus 102B.

Those of ordinary skill in the art will recognize that numerous modifications may be made to the specific implementations described above. Therefore, the following claims are not to be limited to the specific embodiments illustrated and described above. The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others.

What is claimed is:

1. A method for controlling marking stations in a tandem printing system having two printers comprising:

operating at least one marking station in a first printer with reference to a low frequency component and a high frequency of a velocity measurement for a web moving along a web path in the first printer, the velocity measurement for the web in the first printer corresponding to an angular velocity signal obtained from at least one roller in the web path of the first printer;

printing fiducial marks on the web with the at least one marking station in the first printer;

detecting the fiducial marks on the web with a fiducial mark sensor in a second printer after the web exits the first printer;

generating a velocity measurement for the web as the web moves along a web path in the second printer that corresponds with the detected fiducial marks; and operating at least one other marking station in the second printer with reference to a low frequency component and a high frequency component of the velocity measurement of the web moving along the web path in the second printer, the high frequency component of the velocity measurement for the web in the second printer corresponding to an angular velocity signal obtained from at least one roller in the web path of the second printer.

2. The method of claim 1 further comprising:

generating the low frequency component of the velocity measurement of the web in the first printer by passing the velocity measurement for the web in the first printer through a low pass filter; and generating the high frequency component of the velocity measurement of the web in the first printer by passing the velocity measurement for the web in the first printer through a high pass filter.

3. The method of claim 1, wherein the fiducial mark sensor extends across at least a portion the web in a cross-process direction.

4. The method of claim 1 further comprising:

generating the low frequency component of the velocity measurement for the web in the second printer by passing the velocity measurement generated from the detected fiducial marks through a low pass filter; and generating the high frequency component of the velocity measurement for the web in the second printer by passing a velocity measurement that corresponds to an angular velocity signal obtained from at least one roller in the second printer through a high pass filter.

5. The method of claim 1 further comprising:

generating the low frequency component of the velocity measurement of the web in the first printer by passing the velocity measurement for the web in the first printer through a low pass filter; and generating the high frequency component of the velocity measurement in the first printer with reference to a first velocity measurement that corresponds to an angular velocity signal obtained from a first roller in the first printer and a second velocity measurement that corresponds to an angular velocity signal obtained from a second roller in the first printer.

6. The method of claim 5 further comprising:

generating the low frequency component of the velocity measurement for the web in the second printer by passing the velocity measurement generated from the detected fiducial marks through a low pass filter; and generating the high frequency component of the velocity measurement in the second printer with reference to a first velocity measurement that corresponds to an angular velocity signal obtained from a first roller in the second printer and a second velocity measurement that corresponds to an angular velocity signal obtained from a second roller in the second printer.

7. The method of claim 1 further comprising:

generating printhead firing signals in the first printer with a single reflex registration process that receives the low frequency component of the velocity measurement and the high frequency component of the velocity measurement, the velocity measurement being generated with reference to an angular velocity signal obtained from a single roller in the first printer; and generating printhead firing signals in the second printer with a single reflex registration process that receives the low frequency component of the velocity measurement that corresponds to the detected fiducial marks and the high frequency component of the velocity measurement that corresponds to an angular velocity signal obtained from a single roller.

8. The method of claim 7 further comprising:

modifying the velocity measurement that corresponds to an angular velocity signal obtained from a single roller in the first printer with web tension measurements obtained in the first printer; and modifying the velocity measurement that corresponds to an angular velocity signal obtained from a single roller in the second printer with web tension measurements obtained in the second printer.

9. The method of claim 1 further comprising:

generating printhead firing signals in the first printer with a double reflex registration process that receives the low frequency component of the velocity measurement and the high frequency component of the velocity measurement, the velocity measurement being generated with reference to angular velocity signals obtained from at least two rollers in the first printer; and generating printhead firing signals in the second printer with a double reflex registration process that receives the low frequency component of the velocity measurement that corresponds to the detected fiducial marks and the high frequency component of the velocity measurement that corresponds to angular velocity signals obtained from at least two rollers.

10. The method of claim 9 further comprising:

modifying the velocity measurement that corresponds to angular velocity signals obtained from at least two rollers in the first printer with web tension measurements obtained in the first printer; and modifying the velocity measurement that corresponds to angular velocity signals obtained from at least two rollers in the second printer with web tension measurements obtained in the second printer.

11. A printing system comprising:

a first printer that prints fiducial marks on a web as the web moves through the first printer in a process direction;

a second printer that receives the web from the first printer, the second printer including:

a web velocity generator that is configured to detect the fiducial marks printed on the web by the first printer and to generate a web velocity measurement for the web as the web moves through the second printer in the process direction;

a low pass filter operatively connected to the web velocity generator to generate a low frequency web velocity signal;

a first roller that is rotated by the web as the web moves through the second printer and is configured with an encoder to generate an angular velocity signal corresponding to the angular velocity of the first roller as the first roller rotates;

a first converter operatively connected to the encoder for the first roller and configured to generate a web velocity measurement corresponding to the angular velocity of the first roller;

a first high pass filter operatively connected to the first converter to generate a first high frequency web velocity signal; and a controller operatively connected to the low pass filter, the first high pass filter, and a plurality of marking stations in the second printer, the controller being configured to generate firing signals for the marking stations with reference to the low frequency web velocity signal and the first high frequency web velocity signal.

12. The printing system of claim 11, the controller being further configured to generate the firing signals for the marking stations in the second printer using a single reflex registration process.

13. The printing system of claim 11, the second printer further comprising:

a second roller that is rotated by the web as the web moves through the second printer and is configured with an encoder to generate an angular velocity signal corresponding to the angular velocity of the second roller as the second roller rotates;

a second converter operatively connected to the encoder for the second roller and configured to generate a web velocity measurement corresponding to the angular velocity of the second roller;

a second high pass filter operatively connected to the second converter to generate a second high frequency web velocity signal; and the controller being operatively connected to the low pass filter, the first high pass filter, the second high pass filter, and the plurality of marking stations in the second printer, the controller being configured to generate firing signals for the marking stations with reference to the low frequency web velocity signal, the first high frequency web velocity signal, and the second high frequency web velocity signal.

14. The printing system of claim 13, the controller being further configured to generate the firing signals for the marking stations in the second printer using a double reflex registration process.

15. The printing system of claim 13, the second printer further comprising:

a second tension measuring device mounted proximate the second roller along the web path through the second printer, the second tension measuring device being configured to generate a second tension measurement signal that corresponds to a tension of a web moving along the web path in the second printer at the second roller, and the second tension measuring device being operatively connected to the second converter to enable the second linear velocity signal to be generated with reference to the second tension measurement signal.

16. The printing system of claim 11, the second printer further comprising:

an imaging device that extends across the web in a cross-process direction and is configured to generate image data corresponding to the web moving through the second printer in the process direction.

17. The printing system of claim 11, the second printer further comprising:

a first tension measuring device mounted proximate the first roller along a web path through the second printer, the first tension measuring device being configured to generate a first tension measurement signal that corresponds to a tension of a web moving along the web path in the second printer at the first roller, and the first tension measuring device being operatively connected to the first converter to enable the first linear velocity signal to be generated with reference to the first tension measurement signal.

* * * * *